US007975937B2

(12) United States Patent
Poos et al.

(10) Patent No.: US 7,975,937 B2
(45) Date of Patent: Jul. 12, 2011

(54) SYSTEM FOR CREATING A WATER VOID DISPLAY

(75) Inventors: Michael Poos, Calgary (CA); Zachary Ficyk, Concord (CA)

(73) Assignee: Crystal Fountains Inc., Concord, Ontario (CA)

( * ) Notice: Subject to any disclaimer, the term of this patent is extended or adjusted under 35 U.S.C. 154(b) by 629 days.

(21) Appl. No.: 12/062,797

(22) Filed: Apr. 4, 2008

(65) Prior Publication Data

US 2009/0250117 A1 Oct. 8, 2009

(51) Int. Cl.
*B05B 17/08* (2006.01)
*B05B 1/36* (2006.01)

(52) U.S. Cl. ..... 239/17; 239/68; 239/69; 239/193; 239/323

(58) Field of Classification Search ..... 239/12, 239/16–18, 20–23, 67–69, 71, 124, 193, 239/320, 323; 4/489
See application file for complete search history.

(56) References Cited

U.S. PATENT DOCUMENTS

| | | | |
|---|---|---|---|
| 1,563,097 | A | 11/1925 | Milker |
| 2,161,529 | A | 6/1939 | Powers |
| 2,608,827 | A | 9/1952 | Cernocky |
| 4,094,501 | A | 6/1978 | Burnett |
| 4,149,469 | A | 4/1979 | Bigler |
| 4,536,968 | A | 8/1985 | Lopiccolo |
| 4,772,157 | A | 9/1988 | Obermeyer |
| 4,868,799 | A | 9/1989 | Massa |
| 4,877,351 | A | 10/1989 | Enami |
| 4,892,250 | A | 1/1990 | Fuller et al. |
| 4,945,851 | A | 8/1990 | Buckle |
| 4,949,485 | A | 8/1990 | Garrett |
| 5,013,184 | A | 5/1991 | Omachi |
| 5,109,620 | A | 5/1992 | Torrence |
| 5,165,580 | A | 11/1992 | Rosenthal |
| 5,247,710 | A | 9/1993 | Carder et al. |
| 5,282,487 | A | 2/1994 | Timpany |
| 5,344,071 | A | 9/1994 | Peifer |
| 6,053,423 | A | 4/2000 | Jacobsen et al. |
| 6,131,819 | A | 10/2000 | Fuller et al. |
| 6,527,197 | B1 | 3/2003 | Lin |

(Continued)

OTHER PUBLICATIONS

Office Action issued on corresponding Canadian Patent Application No. 2,638,577 dated Nov. 25, 2010.

*Primary Examiner* — Darren W Gorman
(74) *Attorney, Agent, or Firm* — Bereskin & Parr/ S.E.N.C.R.L, s.r.l.

(57) ABSTRACT

A liquid management system comprising a first chamber that has a first boundary wall, and a second chamber that has a second boundary wall. The second chamber has a base surrounded by the second boundary wall and the second boundary wall is within the first boundary wall. The second boundary wall height is lower than the first boundary wall height. The liquid management system also comprises a liquid level control module for controlling i) a first level of the liquid within the first chamber, and ii) a second level of the liquid within the second chamber. The liquid level control module is operable to lower the second level of the liquid in the second chamber below the second wall height while concurrently maintaining the surface level of the liquid in the first chamber higher than the second wall height such that the liquid within the first chamber flows over the second boundary wall from the first chamber into the second chamber to form a void in the liquid, the void has liquid sides inside the second boundary wall.

26 Claims, 10 Drawing Sheets

U.S. PATENT DOCUMENTS 6,527,949 B1 * 3/2003 Hedberg et al. ..... 210/167.01
6,748,699 B2 * 6/2004 Taylor ..... 47/79
7,187,141 B2 3/2007 Mueller et al.
7,229,027 B2 6/2007 Ehresman et al.
2004/0123740 A1 7/2004 Willis, Sr.
2005/0122592 A1 6/2005 McKnight
2006/0042689 A1 3/2006 Hinojosa, Jr.
2007/0051029 A1 3/2007 Ring

* cited by examiner

SYSTEM FOR CREATING A WATER VOID DISPLAY

TECHNICAL FIELD

The present invention relates in general to the design of water fountains for the visual entertainment of the fountain viewers. In particular, the present invention relates to a system for creating a visual water void display within a fountain.

BACKGROUND

Water fountains have long been used. Water fountains, and more generally water display features, can be distinguished from decorative water pools by the behavior of the water contained within the feature.

Traditionally, the water within a decorative pool remains relatively calm and still. In contrast, the water within a fountain is generally moving or otherwise manipulated to create interesting and visually attractive features. One example of such motion is the pouring or streaming of water from one location to another within the fountain.

An example of the pouring water motion is a common waterfall display in which water flows from an elevated position into a collection pool located at a relatively lower elevation. This type of waterfall is often intended to mimic natural waterfall formations. Waterfall displays create an interesting visual effect as the water cascades down from the higher elevation to the lower elevation and they can also create a recognizable audible effect as the water splashes into the lower collection pool.

A typical example of a water-streaming feature is a fountain that comprises a central statue or figure surrounded by a lower collection pool. Typically in this type of water feature, water is pumped from the collection pool up, into the statue where it then escapes the statue through a pre-determined opening and streams back into the collection pool. The predetermined opening in the statue commonly corresponds to the details of the statute itself. For example, the opening may be the mouth of the figure or it may correspond to the opening of a pitcher or jug being held by the figure. Water-streaming displays also create interesting visual and auditory effects to engage an observer.

As technology has improved, the types of visual effects created by moving water within a fountain have also increased. Rather than merely rely on the force of gravity to pull water from a higher elevation to a lower elevation, modern fountain systems commonly use high-pressure piping systems and moveable or adjustable nozzles and sprayers to create a variety of visual effects. In addition, modern water fountain systems typically include a variety of additional devices to be used in combination with the moving water to create an interesting visual effect. Examples of these additional devices include lighting systems, bubbling systems and musical accompaniment. When operated in concert, a modern fountain comprising a plurality of the elements described above can be automated to perform complicated and visually interesting effects.

Despite recent technological advancements, there is a continuing desire for new, innovative visual fountain effects. Therefore, there is a need for a new type of visual fountain effect to entertain fountain observers.

SUMMARY

In accordance with an aspect of an embodiment of the invention there is provided a liquid management system comprising a first chamber that has a first boundary wall and a second chamber that has a second boundary wall. The second chamber has a base surrounded by the second boundary wall and the second boundary wall is within the first boundary wall. The second boundary wall height is lower than the first boundary wall height. The liquid management system also comprises a liquid level control module for controlling i) a first level of the liquid within the first chamber, and ii) a second level of the liquid within the second chamber. The liquid level control module is operable to lower the second level of the liquid in the second chamber below the second wall height while concurrently maintaining the surface level of the liquid in the first chamber higher than the second wall height such that the liquid within the first chamber flows over the second boundary wall from the first chamber into the second chamber to form a void in the liquid, the void has liquid sides inside the second boundary wall.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
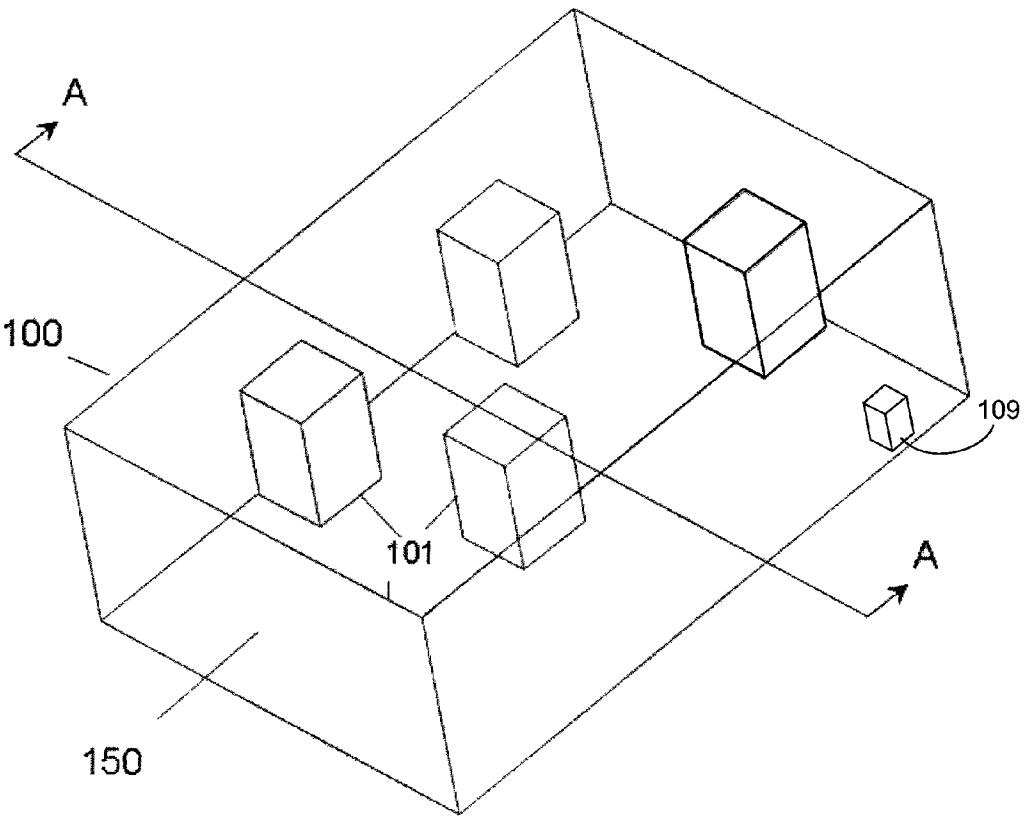
FIG. 1 is an isometric view of a water void display system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Figure 2:
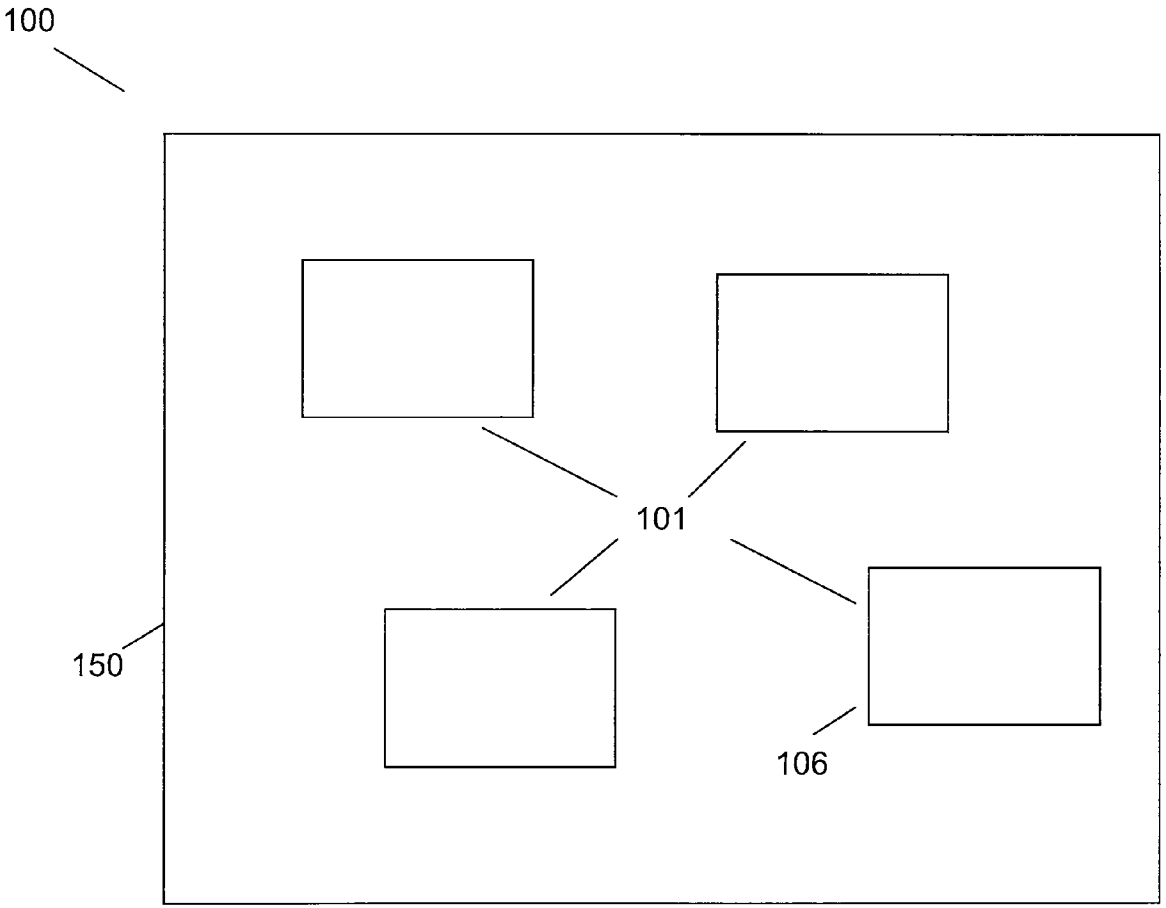
FIG. 2 is a top view of a water void display system.

FIGS. 1 and 2 show a representation of an embodiment of a water void display system 100. FIG. 1 shows a perspective view of the water void display system 100, whereas FIG. 2 shows a top view of the water void display system 100 shown in FIG. 1. The water void display system 100 comprises at least one water void chamber 101 contained within an outer chamber 150. Each water void chamber 101 defines a hollow chamber with a top opening that defines a top perimeter 106. The continuous top perimeter 106 of each water void chamber defines the shape of the water void visible to an observer looking at a fountain containing the water void display system 100.

In the embodiment shown in FIGS. 1 and 2, the top perimeter 106 of each water void chamber 101 defines a simple square, however, it is understood that the perimeter of each water void chamber 101 could be shaped so as to define water voids of any shape desired by the client. For example, water void chambers 101 could have top perimeters 106 that define any closed shape, including circles, triangles, hexagons, stars and rectangles as well as any desired asymmetric closed shape.

During operation of the water void display system 100, the outer chamber 150 can be filled with water. The water in the outer chamber 150 is kept at a substantially constant level to continuously surround the water void chambers 101. The water level of the outer chamber 150 can be maintained at its constant level by any method known to those skilled in the art, including, but not limited to, use of an overflowing edge design and use of a controllable water supply (e.g. a liquid inlet)/drain (e.g. a liquid outlet) apparatus such as liquid inlet 109.

As shown, the embodiment of the water void display system 100 of FIGS. 1 and 2 comprises four water void chambers 101, but it is understood that a water void display system 100 could comprise any number of water void chambers 101 desired. In the embodiment shown in FIGS. 1 and 2, the water void chambers 101 are arranged in a simple off-set or checker-board pattern. However, it is also understood that the water void chambers 101 could be placed in a variety of positions within the outer chamber 150 such that the water void chambers 101 form a desired pattern or shape.

Figure 3:
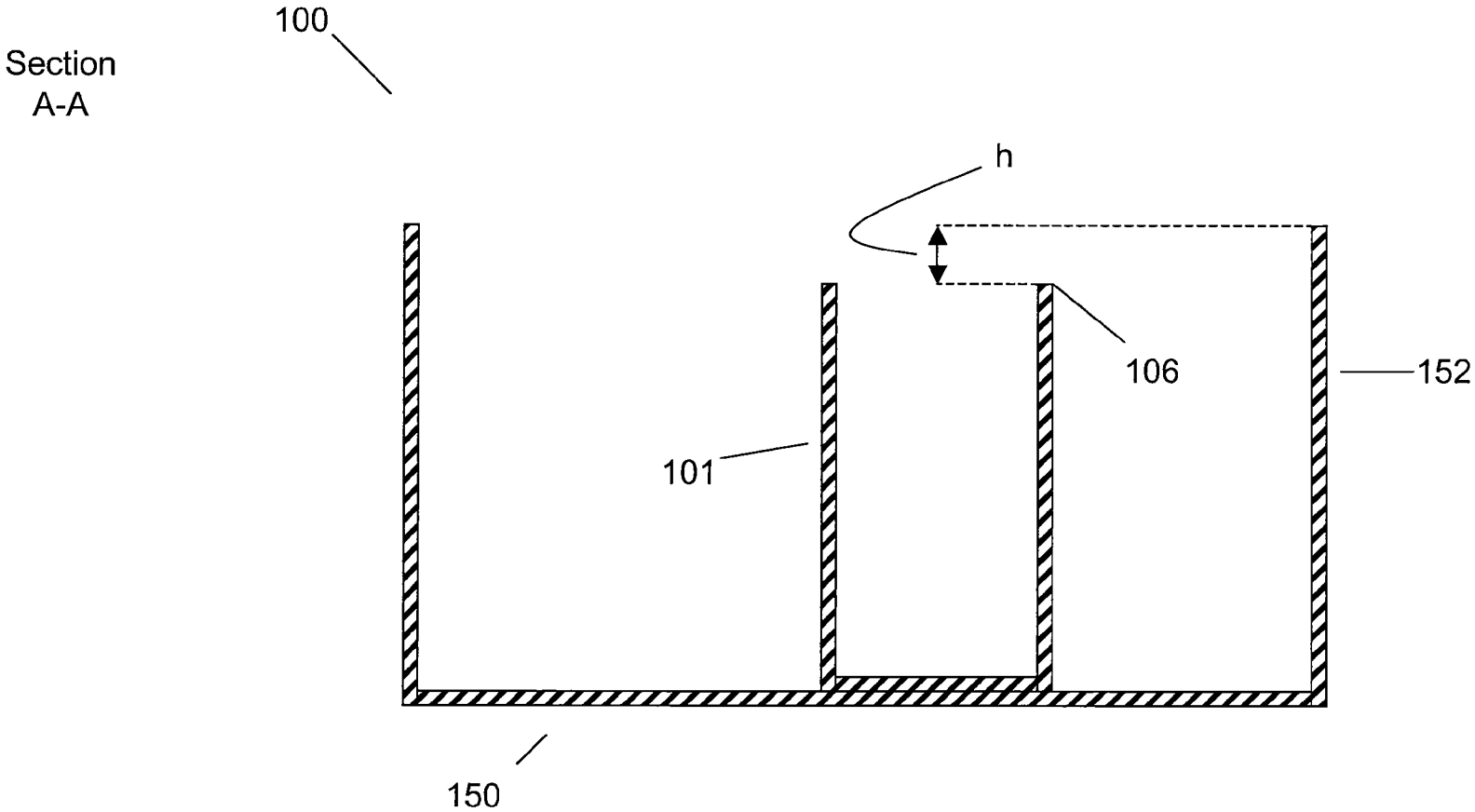
FIG. 3 is a section view of a water void display system.

FIG. 3 is a cross-section view of the water void display system 100 shown in FIGS. 1 and 2. The cross-section is taken along line A-A as shown in FIG. 1. FIG. 3 shows the relative positions of the top perimeter 106 of a water void chamber 101 and the outer chamber walls 152. Specifically, the outer chamber walls 152 extend above the top perimeter 106 of the water void chamber 101 by a distance "h". That is, "h" is the distance between the top of the water void chamber 101 walls and the top of the outer chamber 150 walls. This configuration allows for the water level within the outer chamber 150 to be maintained at a height such that the top perimeter 106 of the water void chamber 101 is submerged. Submerging the top perimeter 106 of the water void chamber 101 reduces its visibility and improves the visual effect of the water void display system 100. The water level of the outer chamber 150 can be maintained at a level such that the water level of the outer chamber 150 is between ⅛" and ½" (or approximately 3-12 mm) above the top perimeter 106. In one embodiment, the water level of the outer chamber 150 could be approximately ¼" (or approximately 6 mm) above the top perimeter 106.

In an embodiment where the water level in the outer chamber 150 is controlled by an overflowing edge design (i.e. the water in the outer chamber 150 flows outward, over the outer chamber walls 152 into a collection system), the water level in the outer chamber 150 may not exceed the value of "h" as shown in FIG. 3. In such an embodiment the value of "h" should be in the range of ⅛" and ½" (or approximately 3-12 mm) and can be ¼" (or approximately 6 mm).

Alternatively, in an embodiment where the water level in the outer chamber 150 is controlled by a water supply/drain apparatus (not shown), the water level in the outer chamber 150 need not be directly determined by the height of the outer chamber walls 152. In this configuration the outer chamber walls 152 must reach a minimum height to prevent water from escaping the outer chamber, but there is no corresponding maximum wall height (as opposed to the overflowing edge design in which there may be a maximum wall height). In this configuration, the outer chamber walls 152 may extend a distance above the water level in the outer chamber 150. Therefore, in this configuration the value of "h" may be any value greater than the minimum value necessary to contain the water in the outer chamber 150 such that the water level is between ⅛" and ½" (or approximately 3-12 mm) and is above the top perimeter 106.

The description of the outer chamber walls 152 above is merely to illustrate two examples of outer chamber wall 152 designs. It is understood that the outer chamber 150 may comprise only a single outer chamber wall 152 (i.e. if the outer chamber is circular), that outer chamber walls 152 may be of different heights (thereby creating different "h" values) and that any given outer chamber wall 152 may vary in height along its length (i.e. a single outer chamber wall 152 may have a regions that contain the water in the outer chamber 150 and regions that allow the water in the outer chamber 150 to overflow).

Figure 8:
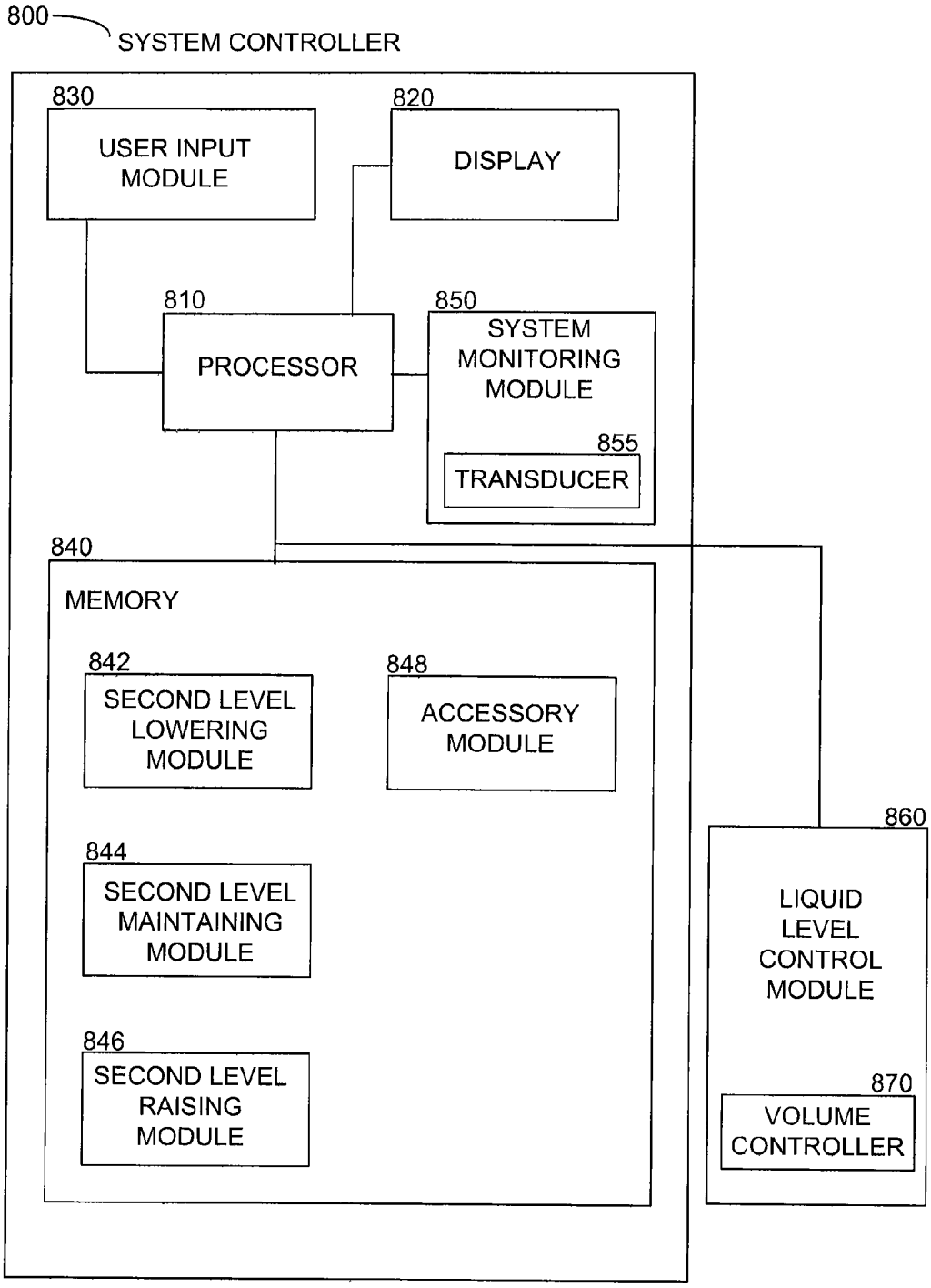
FIG. 8 is an exemplary block diagram illustrating an embodiment of a system controller.

The water void chambers 101 of the water void display system 100 also include a liquid level control module 860 (as shown in FIG. 8) that is used to vary the water level within the water void chamber 101. Via the liquid level control module 860, the water level within the water void chamber 101 can be lowered relative to the water level of the outer chamber 150. To an observer, the lower water level within the water void chamber 101 may visually appear as a depression, or void, in the surface of the water contained within the outer chamber 150. By arranging a number of water void chambers 101 within a single outer chamber 150, a system operator may create a pattern of multiple water voids in a desired configuration. Due to the fact that the top perimeter 106 of the water void chamber 101 can be below the surface level of the water in the outer chamber 150, water from the outer chamber 150 can flow over the top perimeter 106, into the water void chamber 101. The water flowing into the water void chamber 101 at least partially obscures the walls of the water void chamber 101, creating the illusion of the void created in the surface of the outer chamber 150.

The rate at which the water flows over the top perimeter 106, into the water void chamber 101 is the overflow rate, the rate at which water is supplied to the outer chamber 150 is the inflow rate, and the rate at which water is removed from the water void chamber 101 is the outflow rate. Each of these flow rates may be controlled and varied by the liquid level control module 860. The liquid level control module 860 may be configured in a plurality of operating modes, each of which comprises different combinations of the overflow rate, inflow rate and outflow rate.

The liquid level control module 860 can control the outflow rate by controlling the rate at which water exits a water void chamber 101. The rate at which the water exits may be controlled by using a variable position valve, variable speed pump, or other suitable means. Similarly, the liquid level control module 860 can also control the inflow rate by controlling the rate at which water enters the outer chamber 150.

The liquid level control module 860 can also control the overflow rate. The overflow rate can be based on the geometry of a water void display system 100 and can be controlled via the inflow rate. The rate at which water flows over the walls of a water void chamber 101 may depend on the depth of the water above the top of the water void chamber 101 walls. The greater the depth of the water above the walls, the greater the overflow rate of the water into the water void chamber 101 during operation. To maintain a constant overflow rate as well as a constant depth in the outer chamber 150, water may be supplied to the outer chamber 150 at substantially the same rate as it is leaving the outer chamber 150 via the overflow. The liquid level control module 860 may be configured such that it adjusts the inflow rate to substantially equal the overflow rate.

A first operating mode can be a lowering operating mode. In the lowering operating mode, the liquid level control system may be used to lower the water level within the water void chamber 101 to a level that is below the water level in the outer chamber 150. In the lowering mode, the liquid level control system may be configured such that the outflow rate is greater than the overflow rate. Operating the liquid level control module in the first operating mode may be used to create the illusion of a void in the water.

A second operating mode can be a maintaining mode. In the maintaining operating mode, the liquid level control module may be configured to hold the water level within the water void chamber 101 at a constant, reduced level (i.e. when the overflow rate is substantially equal to the outflow rate). In the maintaining operating mode, the visual water void effect can be maintained for prolonged periods of time. A prolonged water void effect may appear to an observer as a "hole" in the surface of the water contained in the outer chamber 150 that is roughly in the shape of the top perimeter 106.

A third operating mode can be a raising mode. In the raising operating mode, the liquid level control module can be configured to raise the water level within the water void chamber 101 such that the water within (and immediately above) the water void chambers 101 returns to the same level as the water in the outer chamber 150. In the raising operating mode, the liquid level control module may be configured such that the overflow rate is greater than the outflow rate. As the water levels equalize, the water void becomes less visually apparent until it vanishes (i.e. when the water in the outer chamber 150 regains a uniform surface height).

During the operation of the water void display system 100, it may be desirable to maintain the surface level of the outer chamber 150 at a constant distance above the top perimeter 106 of a water void chamber 101. The liquid level control module may also be configured to maintain a constant distance between the water surface in the outer chamber 150 and the top perimeter 106. As described above, water from the outer chamber 150 can flow into a water void chamber 101 when the outflow rate exceeds the overflow rate. As water is drawn from the outer chamber 150, the surface level in the outer chamber 150 will lower (reducing the distance between the surface level and the top perimeter 106 and possibly affecting the visual effectiveness of the water void), unless additional water is added to the outer chamber 150 at the same rate. Therefore, if it is desired to prevent the surface level of the outer chamber 150 from decreasing, the liquid level control module can be configured such that the inflow rate is substantially equal to the overflow rate. If a water void display system comprises a plurality of water void chambers 101, the outer chamber 150 inflow rate can be set substantially equal to the total overflow rate (the sum of the overflow rates of each water void chamber 101).

In another embodiment of the water void system 100, the liquid level control modules can be configured to rapidly increase the water level within the water void chambers 101 such that the column of water directly above the water void chambers 101 exceeds the water level of the surrounding water in the outer chamber 150 creating a surge effect, in the shape of the top perimeter 106. In other words, while the water void effect described above creates a potentially long-standing depression in the surface of the water, the surge effect creates a protrusion extending upward from the surface of the water. The shape of the top perimeter 106 governs the shape of the both the void and the surge created.

A system operator may use a system controller 800 (as shown in FIG. 8) to configure the liquid level control module of a water void display system 100 to configure the system to automatically, intermittently lower and raise the water level within each of the water void chambers 101. By intermittently lowering and raising the water level with a water void chamber 101, or any combination of water void chambers 101, the system operator may create a visually attractive, automated fountain display to entertain observers in which a number of visual water voids appear and then disappear.

FIG. 8 shows an exemplary embodiment of a system controller 800 that comprises a memory 840 that contains a plurality of modules 842, 844, 846 and 848 for configuring a processor 810 to automatically operate the liquid level control module 860 as desired pattern. The system controller 800 can also comprise a user input module 830, a display 820, and a system monitoring module 850.

The memory 840 may be any type of volatile or non-volatile memory device known to those skilled in the art.

The user input module 830 can be any type of user input interface known to those skilled in the art. For the purposes of this discussion, the user input module 830 can be understood to comprise a computer keyboard and mouse. However, it is understood that the user input module 830 can be a touch-screen interface, mechanical device, keypad, voice recognition device, or any other device known in the art. Via the user input module 830, a system operator can access, modify and configure any of the modules 842, 844, 846 and 848 stored in the memory 840. By configuring the modules 842, 844, 846 and 848, the system operator can modify the automated operation of the water void display system 100.

Information reflecting the current configuration of the water void display system 100 and the modules 842, 844, 846 and 848, or a variety of other system information, can be displayed to the system operator on the display 820. The display 820 may be any type of display apparatus known in the art such as a computer monitor, a flat panel display, indicator lights, printed information or any other suitable display device. For the purposes of the following example, the display 820 is understood to be a computer monitor. The display 820 may be configured to display graphical representations that correspond to a plurality water void display system 100 elements, settings and configurations.

Based on the information provided by the display 820, a system operator can configure the water void display system 100 to create a number of desired visual effects. The system operator may select the graphic representations of each water void chamber 101 separately to assign each water void chamber 101 an individual display program. For example, when each water void chamber 101 is programmed separately, a first water void chamber 101 may be programmed to appear while a second water void chamber 101 is programmed to close. Alternatively, the system operator may program several water void chambers 101 to act in unison. For example, a system operator may configure the system controller 800 to open all water void chambers 101 simultaneously.

Although described with reference to display 820, it is understood that the system controller 800 need not comprise a display element. For example, the system operator may configure the system to operate in a desired pattern by observing the physical components of the water void display system 100 and adjusting the system values based on the observations. In such a configuration, for example, the display 820 may be unnecessary.

The system operator may configure the system controller 800 in a plurality of operating modes by accessing and utilizing a plurality of software modules 842, 844, 846, and 848. The software modules 842, 844, 846, and 848 can be operable to configure the processor 810 to operate the liquid level control module 860, volume controller 870 and a plurality of other water void display system 100 elements.

Figure 9:
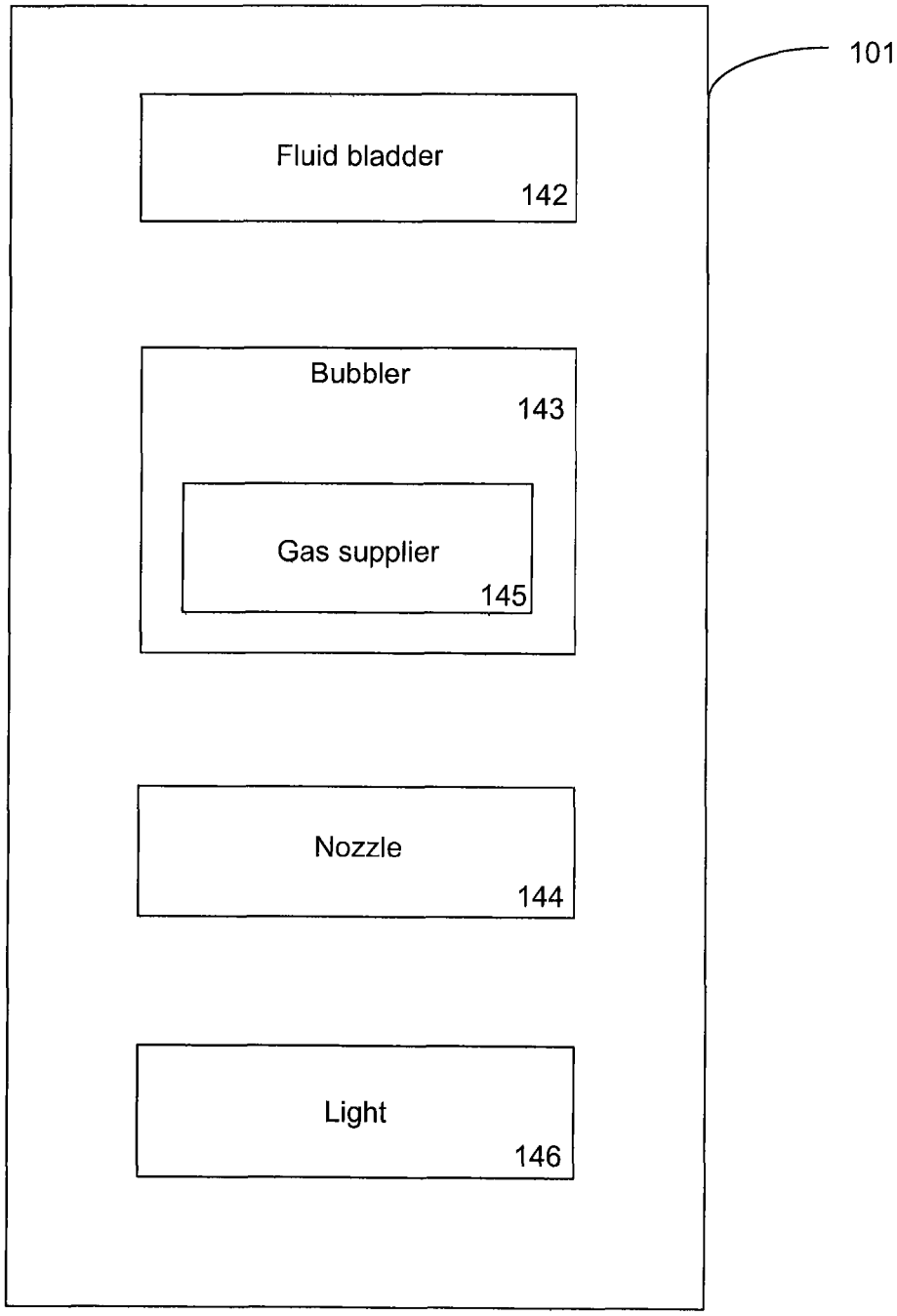
FIG. 9 is an exemplary block diagram illustrating a water void chamber.

An example of a volume controller 870 is the moveable walls 116 that are described in more detail below. Another example of the volume controller 870 is a fluid bladder 142 (as shown in FIG. 9), located within a water void chamber 101, that can be operated in a plurality of configurations. In a first configuration, the bladder may be filled with fluid to increase the volume of the bladder, thereby decreasing the available volume within the water void chamber 101. In a second configuration, the bladder may be drained to decrease the volume of the bladder, thereby increasing the available volume within the water void chamber 101.

Figure 4:
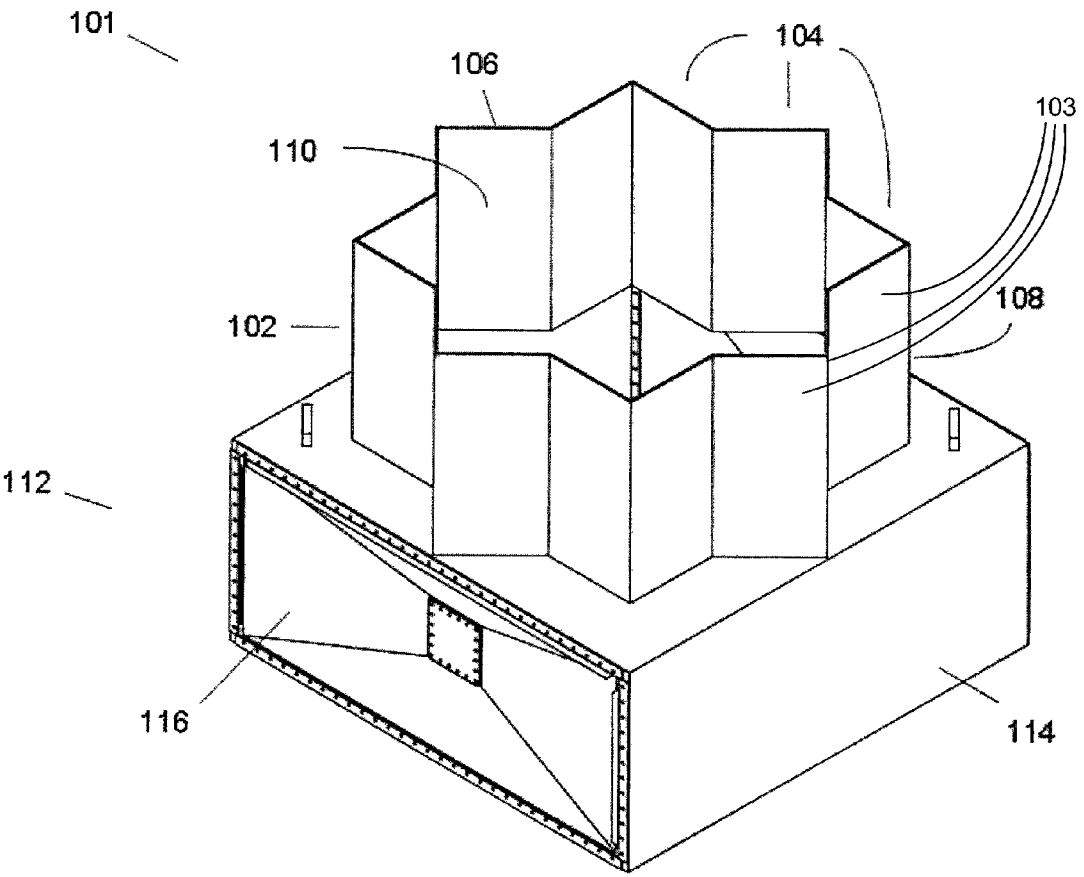
FIG. 4 is an isometric view of a water void chamber.

An example of a software module is the second level lowering module 842. The second level lowering module 842 can be operable to configure the processor 810 to operate the liquid level control module 860 to set outflow rate greater than the overflow rate as described above. Another example of a software module is the second level maintaining module 844. Using the second level maintaining module 844, a system operator can configure the processor 810 to operate the liquid level control module 860 to hold the second level within any given water void chamber 101 at a substantially constant level by setting the overflow rate substantially equal to the outflow rate. A third example of a software module is the second level raising module 846 that can be used by a system operator to configure the processor 810 to operate the liquid level control module 860 to raise the second level within a given water void chamber 101. Each of the second level control modules 842, 844, and 846 may also be operable to configure the processor 810 to control the volume controllers 870 of the water void chambers 101 (e.g. the moveable walls 116 and biasing elements as shown in FIG. 4 and described in more detail below).

Each of the level control modules 842, 844, and 846 may comprise a plurality of settings for creating a variety of water void effects as desired by the system operator. For example, the second level lowering module 842 may be configurable to select which water void chamber 101 is activated as well as being configurable to determine how quickly the water within the water void chamber 101 will react.

The second level lowering module 842 may comprise slow, medium and fast lowering settings. When operated in the slow lowering setting, the second level lowering module 842 may be operable to configure the processor to operate the liquid level control module to set the outflow rate at a level that is slightly greater the overflow rate. In this configuration, the second level of water within the water void chamber 101 may decrease at a relatively slow rate.

When operated in medium lowering setting the second level lowering module 842 may be operable to configure the processor to operate the liquid level control module to set the outflow rate at a level that is significantly greater the overflow rate. In this configuration, the second level of water within the water void chamber 101 could decrease at a faster rate than when the second level lowering module 842 is operated in slow lowering mode.

When operated in fast lowering mode the second level lowering module 842 may be operable to i) configure the processor to operate the liquid level control module to set the outflow rate at a level that is significantly greater the overflow rate, and ii) configure the processor to activate the volume controller 870 to rapidly increase the inner volume of the water void chamber 101. In this configuration, the second level of water within the water void chamber 101 could decrease at a faster rate than when the second level lowering module 842 is operated in slow or medium lowering modes.

It is understood that the second level raising module 846 may comprise a plurality of settings operable to raise the second level of water within a water void chamber 101 at a variety of rates by varying the difference between the outflow rate and the overflow rate. If the system operator wishes to fill a water void quickly, the second level raising module 846 may also be operable to configure the processor 810 to activate the volume controller 870 to rapidly decrease the inner volume of the water void chamber 101.

The second level raising module 846 may also comprise a plurality of user selectable water void end condition settings. A water void end condition can be understood as the visual effect achieved when a water void is completely re-filled. Examples of water void end conditions include the surge effect described above as well as a smooth transition effect in which the second water level within a water void chamber 101 raises to meet, but does not exceed, the first level of the water contained in the outer chamber 150. For example, utilizing predetermined combinations of outflow rate, overflow rate and volume controller 870 movements, the second level raising module 846 may comprise a pre-set "surge effect ending" command that can be selected by a system operator who is configuring the display of a water void chamber 101.

The system controller 800 may be operable to record the rate of change of the second level of water within a water void chamber 101 using a plurality of values. For example, the rate of change of the second level may be expressed as a percentage change in height (with the first level of water in the outer chamber 150 representing a height of 100%) per given unit of time. In such a configuration, a rate of change of the second level could be expressed as decreasing (or increasing) at a rate of 10% per second (10%/s).

The rate of change of the second level may also be expressed in absolute measures. For example, the rate of change of the second level may be expressed as decreasing (or increasing) in inches per second, or metres per minute.

In addition to directly describing the physical position of the second level, the change within a given water void chamber 101 may also be described in terms of volumetric and mass flow rates. For a water void chamber 101 of a known volume, the rate of change of the second level can be based on the flow rate of water entering and exiting the chamber. In this configuration, the rate of change of the second level may be expressed as decreasing or increasing in volumetric flow rates such as gallons per minute, or cubic metres per second. Due to the physical nature of water, a flow rate may also be expressed as a mass flow rate. For example, the rate of change of the second level may be expressed as decreasing or increasing in mass flow rates such as pounds per second, or kilograms per second.

The user input module 830 may be configured to record the rate of change of the second level using a corresponding plurality of values. For example, if the system controller 800 or system monitoring module 850 is configured to monitor second level changes in inches per second, the user input module 830 may also be configured to accept system operator commands in terms of inches per second.

Alternatively, the user input module 830 and display 820 may be configured to describe the second level changes in different terms than the second level control modules 842, 844, and 846.

For example, for ease of use, the user input module 830 may be configured such that it always accepts system operator inputs in terms of inches per second. However, the second level control modules 842, 844, and 846 may be operable to configure the processor 810 to operate the liquid level control module to vary the outlet and overflow flow rates as measured in gallons per minute. Using the known geometry of a water void chamber 101, the user input module may be able to convert the desired change rate in inches per second into a corresponding volumetric flow rate that can be used by the second level control modules 842, 844, and 846

In addition to the second level control modules 842, 844, and 846 described above, the system controller 800 may comprise an accessory module 848 for controlling a plurality of additional fountain features. The accessory module 848 may be operable to control lighting systems, music systems and other water elements such as water jets and bubbling devices. The operation of the accessory module 848 may be coordinated with the operation of the second level control modules 842, 844, and 846.

The system controller 800 may be automated such that it executes a plurality of user selected programs and settings in the absence of ongoing system user inputs. The system monitoring module 850 may be configured to monitor a plurality of system values (i.e. input variables) in order to provide feedback to the system controller 800 regarding the status of a plurality of elements and features of a water void display system 100. For example, a transducer 855 may be provided in communication with system monitoring module 850 and processor 810. Transducer 855 may be operable to measure at least one of the second level of the liquid in the second chamber, the first level of liquid in the first chamber, the inflow rate, the outflow rate and the overflow rate. Information regarding the current status of the water void display system 100 may be used by the system controller 800 as a basis for subsequent automated decision making. For illustrative purposes, an example of an automated water void display system 100 is described below. The exemplary water void display system 100 comprises two water void chambers 101, A and B.

When configuring the water void display system 100, a system operator may desire to have water void chambers 101 A and B create a variety of visual effects. The system operator may also desire that the effects created by water voids A and B be coordinated in order to create an interesting visual effect. Utilizing the system monitoring module 850 allows the system controller 800 to monitor the status of each water void chamber 101 separately, as well as compare their relative configurations.

A system operator may configure the second level control modules 842, 844 and 846 to provide a water void display sequence in which water void A appears, water void A is maintained for 1 minute and then water void A disappears while water void B simultaneously appears at the same rate that water void A vanishes. To accomplish the desired synchronization between water void chambers 101 A and B, the system controller 800 may require ongoing information regarding the status and configuration of each water void chamber 101. Information regarding the water void chambers 101 may be collected by the system monitoring module 850.

For example, the system monitoring module 850 may be configured to record the position of the second level of the water within each water void chamber 101. The system monitoring module 850 may also determine the outflow rate, inflow rate, overflow rate, and second level rate of change for each water void chamber 101. Based on the information collected by the system monitoring module 850, the system controller 800 may be able to determine when water void chamber 101 A begins to disappear and at what rate water void A is closing. Based on this information, the second level control modules 842, 844 and 846 can configure the processor 810 to control the liquid level control module 860 such that water void B opens at substantially the same rate.

A system operator may also wish to integrate the operation of the water void display system 100 in the surrounding environment. For example, a system operator may wish to illuminate the water void display system 100 when the surrounding environment is dark (e.g. at night for an outdoor fountain). As another example, a system operator may wish to activate the water void display system 100 when observers are present but deactivate the system when no one is watching. A plurality of information relating to the water void display system's 100 surroundings may be recorded by any known type of transducer (e.g. photocell, motion detector, pressure transducer, video camera, etc.). Once recorded, the environmental information may be collected and analyzed by the system monitoring module 850. After comparing the recorded data to a set of pre-determined system values, determined by a system operator, the system monitoring module 850 can configure the processor to modify the water void display system 100 based on the surrounding environmental conditions.

A system operator may create additional system configurations by configuring the system controller 800 to activate the software modules 842, 844, 846, and 848 and the system monitoring module 850 in a desired sequence or pattern. By configuring the system controller 800 to activate various modules at various times, a system operator can create a plurality of visual effects. The system controller 800 may also be configured to automatically complete a plurality of operating programs designed by a system operator.

In the description above, the second level control modules 842, 844, and 846, the accessory module 848 and the system monitoring module 850 have been described as software programs operable to configure the processor 810. It is understood that some or all of the functions of the modules may be accomplished using hardware components or a combination of hardware and software components.

FIG. 4 shows an isometric view of an embodiment of a water void chamber 101. The water void chamber 101, as shown in FIG. 4, is divided into a top portion 102 and a bottom portion 112. The bottom portion 112 comprises an example of a volume controller 870 as described above with reference to FIG. 8.

The top portion 102 of the water void chamber 101 is defined by a plurality of chamber walls 103. Together, the chamber walls 103 define a continuous top portion outer surface 108 and a top portion inner surface 110. In operation, the top portion outer surface 108 can be surrounded by the water contained within the outer chamber 150 (shown in FIGS. 1 to 3) whereas the top portion inner surface 110 surrounds any water contained within the water void chamber 101.

Each of the chamber walls 103 has a top edge 104. Together, the top edges 104 of all the chamber walls 103 define the top perimeter 106 of the water void chamber 101 as described above. The top perimeter 106 defines the shape of a water void or water surge created by the water void chamber 101. As described above, the top portion 102 of a water void chamber 101 may only comprise a single chamber wall 103 (if the chamber is circular) in which case the top perimeter 106 would be defined by a top edge 104.

Figure 5:
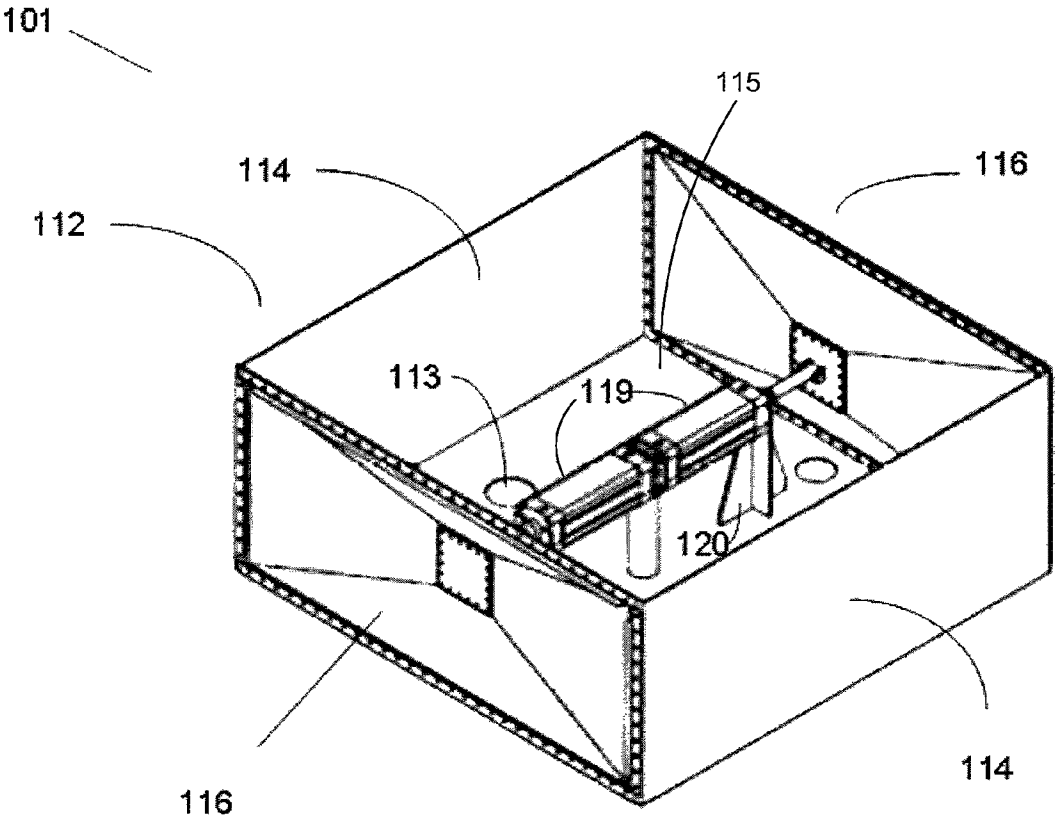
FIG. 5 is an isometric view of a water void chamber with the top portion removed to reveal the inside of the bottom portion.
Figure 6:
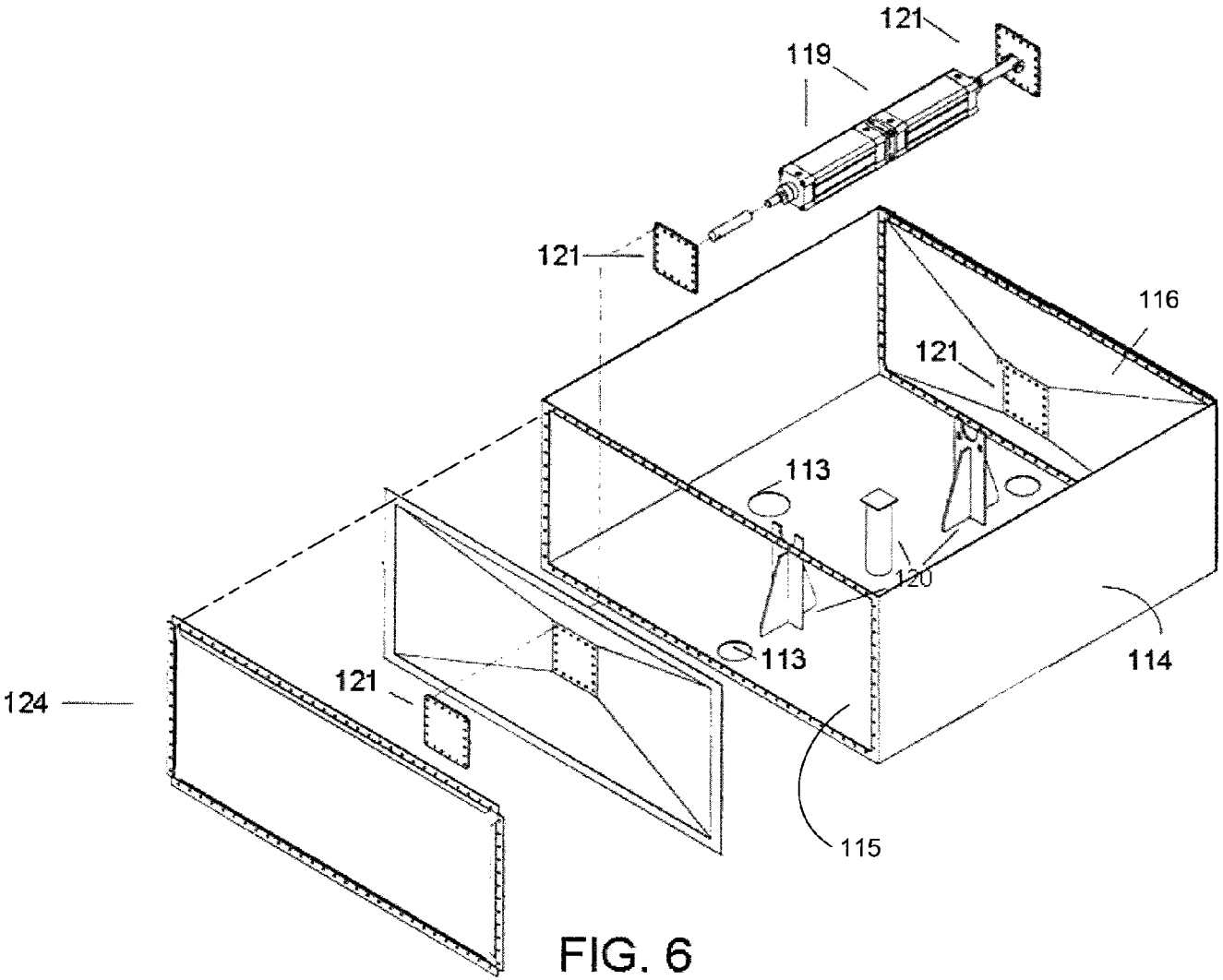
FIG. 6 is an exploded view of the bottom portion of a water void chamber.

The bottom portion 112 of the embodiment of the water void chamber 101 comprises two fixed walls 114, a fixed base 115 (shown in FIG. 5) and two moveable walls 116. The bottom portion 112 is adjacent to the top portion 102 to define the boundaries of the water void chamber 101. In the embodiment of the water void chamber 101 shown in FIGS. 4 through 6, the bottom portion 112 of the water void chamber 101 comprises two moveable walls 116. It is understood that a water void chamber 101 could also operate having more or fewer moveable walls 116 and that a water void chamber 101 could include a moveable base 115. It is also understood that the biasing elements may be located within the water void chamber 101 (as shown in FIGS. 4-6) or the biasing elements may be located outside the water void chamber 101. In this configuration, the volume controller 870 can be understood as comprising the moveable walls 116 as well as biasing elements necessary to move the walls.

During operation of the water void display system 100, the top portion 102 of the water void chamber 101 can remain stationary. In other words, the top perimeter 106 can remain fixed at all times during the water level changing operations of the water void chamber 101 (described below). Having a fixed top perimeter 106 allows the water voids created to have a consistent shape, and may also help to sustain the effect of a void forming in the surface of the water itself, without apparent cause.

In addition to defining the visible shape of the water voids, the design of the top perimeters 106 of the water void chambers 101 in a water void display system 100 determine the turbulence of the water flowing over the top perimeter 106 into the water void chamber 101. Specifically, the profile (i.e. the cross-sectional shape) of each top edge 104, which together form the top perimeter 106, can be chosen from a plurality of shapes, known to those skilled in the art, in order to achieve the desired turbulence levels in the water flowing over the top edges 104 and into the water void chamber s101.

For example, a client may desire the water flowing into the water void chamber 101 to have a smooth, clear, and glass-like visual appearance. The incoming water flow can have a smooth, glass-like appearance if the flow is laminar. It would be known to a person skilled in the art that the water flowing of the top edges 104 may be laminar if the profile shape of the top edges 104 is generally curved and smooth, without sharp edges. The precise curvature of the top edges 104 necessary to achieve laminar flow is based on a known set of fluid flow characteristics and can be determined by a person skilled in the art.

Alternatively, a client may desire the water flowing into the water void chamber 101 to have a translucent, foamy and bubbly-like visual appearance. Water flowing into the water void chambers 101 can have the desired translucent, foamy and bubbly-like visual appearance if the flow is turbulent. It would be known to a person skilled in the art that the water flowing over the top edges 104 may be turbulent if the profile shape of the top edges 104 has sharp edges or rough surfaces. In response to the client's desires, a person skilled in the art can select a top edge 104 profile shape to achieve the desired flow conditions.

The two examples described above are merely illustrative of two possible top edge 104 profile designs. It is understood that a person skilled in the art can modify the profile design on the top edges 104 in order to meet the visual requirements of a client. For example, it is possible for the individual top edges 104 within a top perimeter 106 to have different profile shapes, allowing for different visual effects to be created. For example, the top edges 104 may be shaped and arranged in an alternating pattern such that the water flowing into a water void chamber 101 has alternating laminar and turbulent flow portions.

In another embodiment of the water void display system 100, the top edge 104 profile shapes may be uniform in a given water void chamber 101, but may vary in each chamber within the water void display system 100. In this embodiment, a single water void display system 100 may contain water void chambers 101 with the foamy, turbulent visual effects as well as water void chambers 101 with the glassy, laminar flow visual effects.

FIG. 5 shows an isometric view of the embodiment of the water void chamber 101 of FIG. 4 with the top portion 102 removed. FIG. 6 shows an exploded view of the bottom portion 112 of the water void chamber 101 shown in FIG. 5. As shown, the bottom portion 112 of the water void chamber 101 comprises the fixed walls 114, the fixed base 115 and a pair of moveable walls 116. The bottom portion 112 also includes two liquid level control features of embodiments of the liquid level control module mentioned above, and described in further detail below.

One liquid level control feature of a first embodiment of a liquid level control module is a water drain/supply opening 113. In the embodiment of the water void chamber 101 shown, the bottom portion 112 has three water drain supply openings 113. The water drain/supply openings 113 can be connected to any water drainage or supply system currently known in the art (not shown) in order to control the water or other liquid level within the water void chamber 101.

If, for example, water is allowed to drain from the water void chamber 101 via the water drain/supply openings 113 at a faster rate than water is entering the water void chamber 101, by flowing over the top perimeter 106, then the water level in the water void chamber 101 will decrease. Conversely, if water is pumped into the water void chamber 101 via the water drain/supply openings 113, or if water is drained from the water void chamber 101 at a slower rate than water is flowing into the chamber, then the water level within the water void chamber 101 will increase.

When the water level within the water void chamber decreases below the level of the surrounding water in the second chamber 150 a visual water void is created. When the water level within the water void chamber 101 is subsequently increased to match the level of the surrounding water in the outer chamber 150, the water void disappears. If the rate of water flowing out of the water void chamber 101 is substantially equal to the rate of water flowing into the water void chamber 101, the water level within water void chamber can be held substantially constant. The rate of change of the water level within the water void chamber 101 can also be controlled by varying relative in-flow and out-flow rates described above. The greater the difference between the in-flow and out-flow rates, the faster the water level within the water void chamber 101 can change.

The liquid level control module may also comprise in some embodiments another liquid level control features, a volume controller 870, that is operable to vary the volume of the water void chamber 101. One example of a volume controller 870 in a water void chamber 101 is the pair of moveable walls 116. The moveable walls 116 are operable to vary the volume of the bottom portion 112 of the water void chamber 101. The moveable walls 116 can be made of any flexible or elastic material with the necessary strength and stiffness characteristics, such as a polyolefin polymer. The moveable walls 116 can be made from a flexible, but non-elastic material such as a thermoplastic polymer membrane. That is, moveable walls 116 may comprise flexible panels. The moveable walls 116 can be coupled to the fixed walls 114 and the fixed base 115 by retaining brackets 124, such that together, the moveable walls 116, fixed walls 114 and fixed base 115 form a continuous, liquid impermeable surface.

Figure 7A:
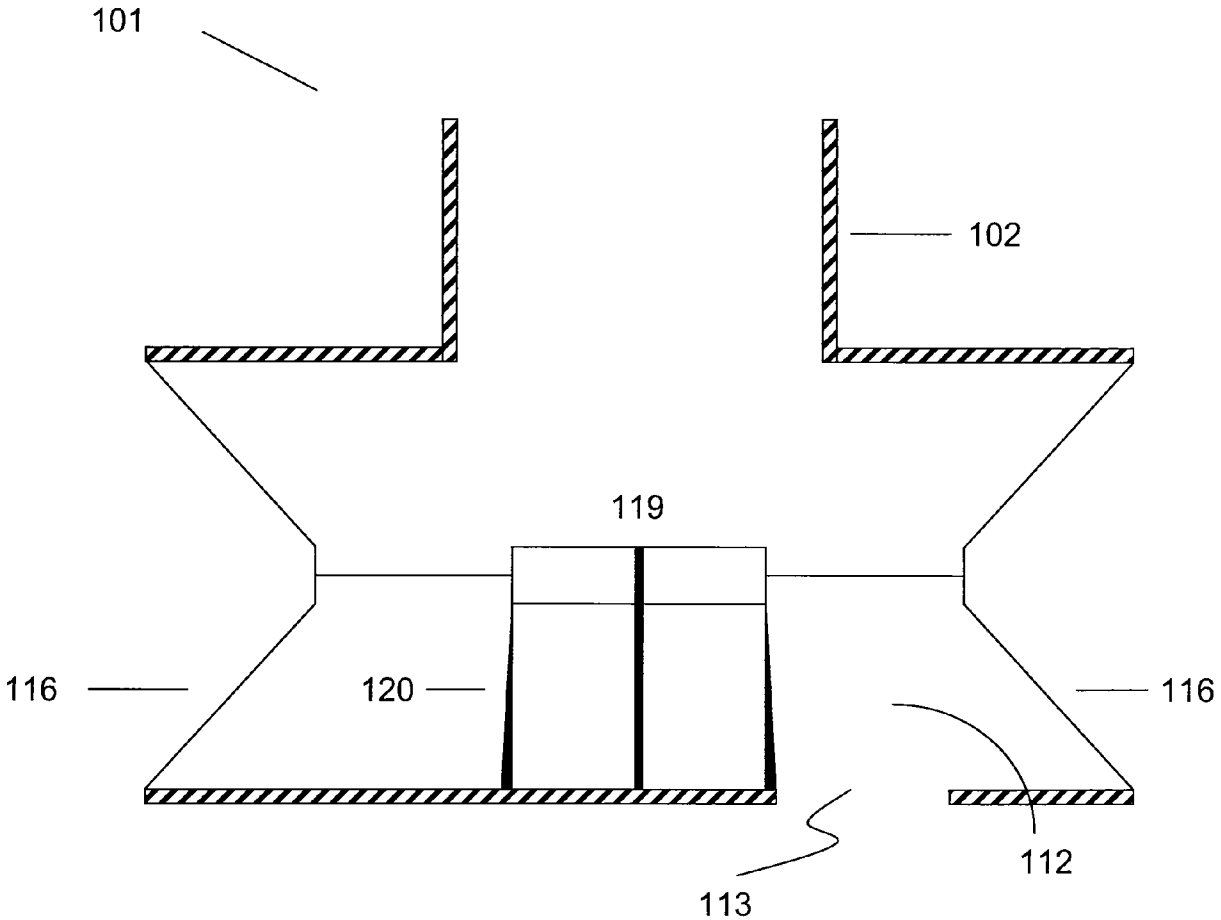
FIG. 7*a* is a section view of a water void chamber with its moveable walls in a retracted position.
Figure 7B:
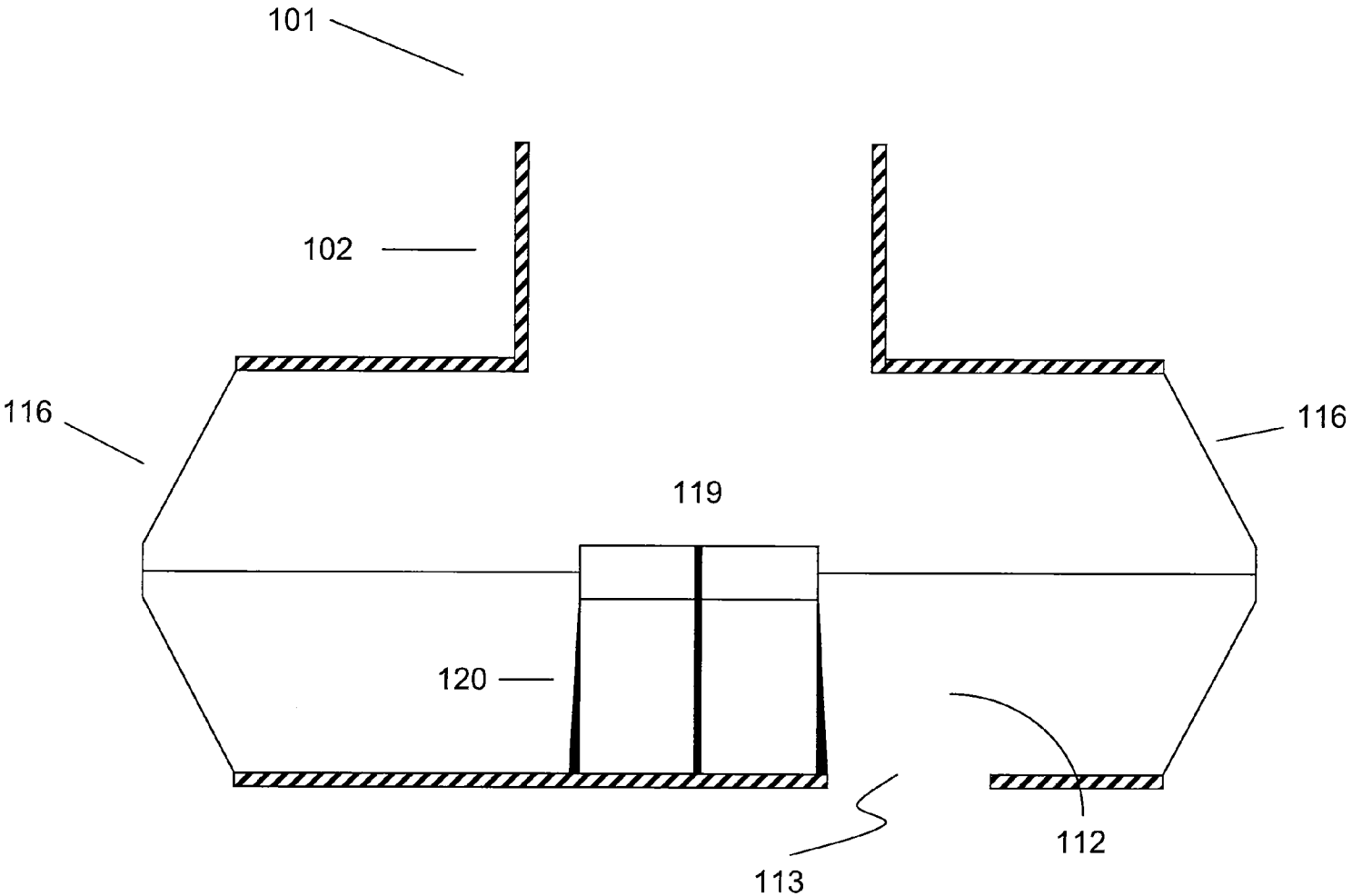
FIG. 7*b* is a section view of a water void chamber with its moveable walls in an extended position.

The moveable walls 116 are moved by a biasing element and are moveable between a first and a second position, such as a retracted position and an extended position (as shown in FIGS. 7*a* and 7*b* respectively). In the embodiment of the water void chamber 101 shown in FIGS. 4 through 6 the biasing elements are pneumatic actuators 119. The pneumatic actuators 119 are attached to the fixed base 115 by the pneumatic actuator mounting brackets 120 such that the pneumatic actuators 119 remain stationary relative to the fixed base 115 of the water void chamber 101. A moveable portion of the pneumatic actuator 119 is attached to the moveable walls 116. In the embodiment of the water void chamber 101 shown, the pneumatic actuators 119 are coupled to the moveable walls 116 using mounting plates 121. The use of the mounting plates 121 spreads the pneumatic actuators' 119 force across a greater surface area of the moveable walls 116, thereby reducing the amount of stress in the moveable walls 116.

As shown in FIGS. 7*a* and 7*b*, the moveable walls 116 are moveable between a retracted position and an extended position. FIG. 7*a* shows a cross section view of an exemplary embodiment of a water void chamber 101 with the moveable walls 116 in the retracted position. As described above, the water void chamber 101 has a fixed top portion 102 adjacent to a bottom portion 112 that comprises two moveable walls 116. Also as described above, the moveable walls 116 are moved by pneumatic actuators 119 that are secured to the water void chamber 101 via the pneumatic actuator mounting brackets 120. FIG. 7*b* is a cross section view that illustrates the water void chamber 101 shown in FIG. 7*a* with the moveable walls 116 in the extended position.

When the moveable walls 116 are moved from the retracted position (FIG. 7*a*) to the extended position (FIG. 7*b*) the volume of the bottom portion 112 of the water void chamber 101 increases. The increase in the volume of the bottom portion 112 allows water from the top portion 102 to flow down into the bottom portion 112. The flow of water from the top portion 102 to the bottom portion 112 results in a decrease in the water level within the water void chamber 101. The moveable walls 116 can be configured to move at a desired rate such that water level within the water void chamber 101 will decrease at a rate in the range of approximately 5% to 50% of the initial second level height (i.e. approximately the water void chamber 101 height) per second. Preferably, the moveable walls 116 are configured to move at a given speed such that the water level within the water void chamber will decrease at a rate of at least 10% of the initial second level height per second, or even 20% of the initial second level height per second.

When the moveable walls 116 are returned to the retracted position the volume of the water void chamber 101 is reduced. The reduction in water void chamber 101 volume increases the water level within the chamber. The increase in water level can be achieved at the same rates as the decrease in water level as described above. If the water level increase is sufficiently rapid, the water contained within the water void chamber 101 will be forced out of the chamber with sufficient momentum to momentarily rise above the surface of the water in the outer chamber 150. Such a rapid water level increase, via a rapid water void chamber 101 volume decrease, can produce the visual surge effect described above.

When the moveable walls 116 are in the retracted position, the pneumatic actuators 119 may be in their minimum extension configuration. For example, if the pneumatic actuator 119 is a pneumatic cylinder containing a movable piston, its minimum extension configuration is understood to be the configuration in which the cylinder is recessed into the cylinder as far as possible. Alternatively, when the moveable walls 116 are in the retracted position, the pneumatic actuators 119 may be in a position other than their minimum extension configuration (an example of a third position). For example, the pneumatic cylinder and piston described above may be configured such that the piston is not fully recessed into the cylinder when the moveable walls 116 are in the retracted position.

Similarly, when the moveable walls are in the extended position, the pneumatic actuators 119 may be in their maximum extension configuration (where the piston is extended as far as possible from the cylinder) or the pneumatic actuators 119 may be in a configuration in which they are not fully extended (another example of a third position).

In an embodiment of the water void chamber 101, the pneumatic actuators 119 may also be configured to extend to a plurality of partially-extended positions in which the pneumatic actuator 119 is configured to locate the moveable walls 116 at a position intermediate between the retracted and extended positions, as shown in FIGS. 7*a* and 7*b* respectively. As described above, changing the position of the moveable walls 116 can affect the water level within the water void chamber 101. Configuring the pneumatic actuators 119 to be moveable to a plurality of extension positions can enable a water void chamber 101 to create a plurality of water voids having different depths, durations and appearing and vanishing times.

For example, a pneumatic actuator 119 may be configured such that when it extends from the retracted position to the extended position a water void is created having a depth of one foot. The same pneumatic actuator may also be configured such that it can extend from the retracted position to an intermediate, partially-extended position such that it creates a water void having a depth of half a foot. Operating the pneumatic actuators 119 intermittently, a water void chamber 101 may create a water void that appears, changes its depth from half a foot to one foot, and then from one foot back to half a foot before vanishing.

In addition to being extendable to a plurality of pre-determined extension locations, the pneumatic actuators 119 may be configured such that they are continuously variable (ie they can smoothly extend to any position between the retracted and extended positions, rather than extending to a plurality of fixed locations). Operating the pneumatic actuators 119 in a continuously variable mode allows a water void chamber 101 to create additional types of water void effects that may not have been possible to create using pneumatic actuators 119 operating between fixed extension positions. The position of the pneumatic actuators 119 may be controlled by controlling the amount of air supplied.

While the above description outlined possible configurations for pneumatic actuators 119, specifically pneumatic cylinders, it is understood that the same results can be achieved using hydraulic actuators, electrical actuators or any other biasing elements known to those skilled in the art.

The water void display system 100 may also be configured such that the pneumatic actuators 119 (or any other appropriate biasing element) may be located outside the water void chamber 101. In such a configuration, the pneumatic actuators 119 may be located within the outer chamber 150, or alternatively the pneumatic actuators 119 may be located outside the outer chamber 150. If the pneumatic actuators 119 are located outside the water void chamber 101, they may still be configured to move the moveable walls 116 between a retracted position (as shown in FIG. 7*a*) and an extended position (as shown in FIG. 7*b*).

Pneumatic actuators 119 located outside the water void chamber 101 may be configured to achieve the same visual water void effects described above. However, if the pneumatic actuators 119 are located outside the water void chamber 101 they may be configured to operate in an opposite manner compared to pneumatic actuators 119 located within the water void chamber 101. For example, if the pneumatic actuators 119 are located outside the water void chamber 101, the moveable walls 116 may be moved to the retracted position (as shown in FIG. 7*a*) by extending the pneumatic actuators, as opposed to retracting the actuators as described above. Similarly, the moveable walls 116 may be moved to the extended position (as shown in FIG. 7*b*) by retracting the pneumatic actuators 119, as opposed to extending the actuators as described above.

Positioning the pneumatic actuators 119 outside the water void chamber 101 may enhance the visual effect created by a water void, and it may allow for the installation of additional fountain features or hardware within the water void chamber 101. It is also possible for a water void chamber 101 to be configured such that it comprises a pair of pneumatic actuators 119 located within the water void chamber 101 (inner actuators) and a pair of pneumatic actuators located outside the water void chamber 101 (outer actuators). In such a configuration the pneumatic actuators 119 coupled to a given moveable wall 116 may operate in concert to move the moveable wall 116 between the retracted and extended positions. When the moveable wall 116 is in the retracted position, the inner actuator may be retracted while the outer actuator is extended, as described above. When the moveable wall 116 is moved to the extended position, the inner actuator may extend while the outer actuator contracts. By operating the inner and outer actuators in tandem, it may be possible for the moveable walls 116 to change position more quickly, creating an enhanced visual effect. It may also be possible for each individual pneumatic actuator 119 to be physically smaller while still being able to move the moveable walls 116 to achieve the desired visual effect.

The water drain/supply openings 113 within the water void chambers 101 can operate in concert with positioning of the moveable walls 116 in order to achieve the desired visual water void effect. For example, a rapid increase in the water void chamber 101 volume can result in a rapid drop in the water level within the water void chamber 101. The rapid drop in water level allows for a water void to rapidly appear in the surface of the water contained in the outer chamber 150. To maintain the water void effect, after the initial drop in water level cause by the increase in chamber volume, the flow rate out via the water drain/supply opening can be set substantially equal to the flow rate of the water entering the water void chamber 101 (as described above).

After a given length of time (either operator selected or predetermined by the automatic system controller) the water void can be closed. Closing the water void can be a gradual process, by slowly returning the moveable walls 116 to the retracted position or by reducing the out-flow via the water drain/supply means 113 relative to the in-flow of water flowing over the top perimeter 106. Alternatively, the closing of the water void can be a rapid process, by rapidly returning the moveable walls 116 to the retracted position.

As described above, the liquid level control modules can be operable to increase the water level within a water void chamber 101 to a level that exceeds the surface level of the outer chamber 150 (surge effect) and to decrease the water level within the water void chamber 101 (void effect). Using the liquid level control modules the water level within the water void chamber may be lowered to the bottom of the chamber 101 thereby exposing the interior of the water void chamber 101 to an observer. Preferably, the water level within the water void chamber 101 is maintained at a level that is above the pneumatic actuators 119 and any other structural elements that may be present within the water void chamber 101. For example, the water void chamber 101 may be configured such that the water level within the chamber does not drop below the top portion 102 of the water void chamber 101. Keeping the water level in the top portion 102 of the water void chamber 101 may help to visually obscure the structural features within the chamber.

Also, as described above, when the water level in the water void chamber 101 drops below the surface level of the outer chamber 150, water can flow over the top perimeter 106 into the water void chamber 101. The water flowing into the water void chamber 101 may visually obscure the inner surface of chamber walls 103 such that an observer may see only flowing water entering the void, as opposed to seeing the chamber walls 103. In the embodiment described, the water flowing into the water void chamber (visually obscuring the chamber walls 103), in conjunction with the water level within the water void chamber 101 being maintained in the top portion 102 (visually obscuring the bottom of the chamber) may create the visual illusion of a void appearing in the water contained in the outer chamber 150 without any structural elements of the water void chamber 101 being visible to the observer.

Using the combination of the moveable walls 116 and the water drain/supply openings 113, a given water void chamber 101 can create a variety of water voids (for example varying depths, opening times, closing times) and surge effects. Therefore, a water void display system 100 that comprises a plurality of water void chambers 101 can create a visual display that includes a mixture of a plurality of water voids and surges. The operation of each water void chamber 101 within a water void display system 100 can be manually controlled by a system operator or automatically controlled by a system controller (not shown). Preferably, the water void display system 100 will comprise a system controller that is operable to control each water void chamber 101 within the system. Under the control of the system controller, the water void chambers 101 could operate in a predetermined sequence thereby creating interesting visual effects (combinations of voids and surges) visible to observers. The system controller may also be operable to co-ordinate and interact with a plurality of known fountain features. Examples of such known fountain features include water jets, musical accompaniment, submerged lighting systems (such as submerged lighting system 146 as shown in FIG. 9), above water lighting systems, bubbler systems and fog nozzles.

Embodiments of the water void display system 100 may also include additional fountain features installed with the water void chambers 101. For example, a water jet nozzle (such as nozzle 144 shown in FIG. 9) may be installed within a given water void chamber 101 enabling a stream of water to be shot upwards, out of the water void chamber 101 during operation. In some embodiments, the water jet nozzle may be installed such that it is submerged when the water level within the water void chamber 101 is high, but when the water level within the water void chamber 101 is lowered, the water jet nozzle becomes partially exposed allowing a stream of water to be shot out of the water void chamber 101. The water jet nozzle may be of any spray type known to those skilled in the art. Further, the water jet nozzle may be a fixed nozzle, or it may be an articulated, controllable nozzle.

Another embodiment of a water void chamber 101 may comprise a bubbler system (such as bubbler system 143 shown in FIG. 9) comprising a gas supplier 145 to create a plurality of bubbles in the water within the water void display system 100. In one embodiment, the bubbler system may be configured to create bubbles within the water void chamber 101, in order to create a desired visual effect. In another embodiment, the bubbler system may be configured to create bubbles in the outer chamber 150. Bubbles in the outer chamber 150 may be positioned at a variety of desired locations to create a variety of visual effects. For example, the bubbler system may be configured such that it creates a bubble perimeter surrounding a water void chamber 101, so that a water void appears surrounded by a ring of bubbles.

While the above description provides examples of the embodiments, it will be appreciated that some features and/or functions of the described embodiments are susceptible to modification without departing from the spirit and principles of operation of the described embodiments. For example, the value of "h" described above may be outside the described range of ⅛" to ½". Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A liquid management system comprising:

a first chamber for containing a liquid, the first chamber having a first boundary wall;

a second chamber for containing the liquid, the second chamber having a second boundary wall and a base surrounded by the second boundary wall, the second boundary wall being within the first boundary wall and having a second wall height lower than a first wall height of the first boundary wall; and a liquid level control module for controlling i) a first level of the liquid within the first chamber, and ii) a second level of the liquid within the second chamber, the liquid level control module being operable to lower the second level of the liquid in the second chamber below the second wall height while concurrently maintaining the surface level of the liquid in the first chamber higher than the second wall height such that the liquid within the first chamber flows over the second boundary wall from the first chamber into the second chamber at an overflow rate to form a void in the liquid, the void having liquid sides inside the second boundary wall.

2. The liquid management system as defined in claim 1 wherein the second boundary wall entirely surrounds the base of the second chamber, and is entirely surrounded by the first chamber, such that the void has a void surface entirely defined by the liquid sides and the base.

3. The liquid management system as defined in claim 2 wherein the liquid level control module is operable to control the second level of the liquid within the second chamber such that base of the void is defined by the base of the second chamber.

4. The liquid management system as defined in claim 2 wherein the liquid level control module is operable to control the second level of the liquid within the second chamber such that base of the void is a liquid base above the base of the second chamber.

5. The liquid management system as defined in claim 1 further comprising a liquid inlet for supplying the liquid to the first chamber at an inflow rate;

a liquid outlet for drawing the liquid out of the second chamber at an outflow rate;

a system controller for controlling the liquid level control module to configure at least one of the liquid inlet and the liquid outlet to operate in a plurality of operating modes to control the inflow rate and the outflow rate such that i) in a first operating mode the outflow rate is greater than the overflow rate of liquid over the second boundary wall and into the second chamber from the first chamber to lower the second level of the liquid in the second chamber relative to the first level of the liquid, ii) in a second operating mode the outflow rate is less than the overflow rate of liquid over the second boundary wall and into the second chamber from the first chamber to raise the second level of the liquid in the second chamber relative to the first level of the liquid, and iii) in a third operating mode the outflow rate substantially equals the overflow rate of liquid over the second boundary wall and into the second chamber from the first chamber such the second level of the liquid in the second chamber is maintained at a substantially equal position relative to the first level of the liquid in the first chamber.

6. The liquid management system as defined in claim 5 wherein the liquid level control module is operable to adjust at least one of the inflow rate and the outflow rate in order to raise or lower the second level of the liquid at a rate of at least 20% reduction in initial height per second.

7. The liquid management system as defined in claim 5 wherein the liquid level control module further comprises a volume controller for controlling a volume of the second chamber, the volume controller being operable to i) rapidly increase the volume of the second chamber to rapidly lower the second level of the liquid without releasing liquid from the second chamber; and, ii) rapidly decrease the volume of the second chamber to rapidly raise the second level of the liquid to the first level of the liquid such that the void disappears.

8. The liquid management system as defined in claim 7 wherein the second boundary wall has a top portion and the volume controller is operable to increase and decrease the volume of the second chamber without moving the top portion.

9. The liquid management system as defined in claim 8 wherein the volume controller is operable to increase and decrease the volume of the second chamber by moving a moveable bottom portion of the second boundary wall.

10. The liquid management system as defined in claim 9 wherein the volume controller is operable to move the moveable bottom portion of the second boundary wall intermittently between;

a first position, wherein the moveable bottom portion is displaced inward, into the second chamber to reduce the volume of the second chamber; and a second position wherein the moveable bottom portion is displaced outward to increase the volume of the second chamber.

11. The liquid management system as defined in claim 10 wherein the volume controller is operable to move the moveable bottom portion of the second boundary wall intermittently between the first position and a third position, wherein the third position is an intermediate position located between the first position and the second position.

12. The liquid management system as defined in claim 10 wherein the moveable bottom portion of the second boundary wall comprises a flexible panel.

13. The liquid management system as defined in claim 10 wherein the volume controller comprises at least one of a pneumatic actuator, a hydraulic actuator and an electric actuator for moving the moveable bottom portion between the first position and the second position.

14. The liquid management system as defined in claim 8 wherein the volume controller comprises a fluid bladder located within the second chamber wherein the fluid bladder has;

a first configuration, wherein the fluid bladder is filled with fluid to increase the volume of the bladder thereby reducing the volume of the second chamber; and a second configuration, wherein the fluid bladder is evacuated to decrease the volume of the bladder thereby increasing the volume of the second chamber.

15. The liquid management system as defined in claim 1 further comprising a light source for illuminating an interior of the second chamber.

16. The liquid management system as defined in claim 1 wherein a top edge of the second boundary wall has a profile for imparting turbulence to the liquid flowing over the profile from the first chamber into the second chamber.

17. The liquid management system as defined in claim 16 wherein the top edge of the second boundary wall has a smooth profile such that the fluid flow from the first chamber into the second chamber is laminar.

18. The liquid management system as defined in claim 1 wherein the liquid level control module is further operable to intermittently raise the second level of the liquid in the second chamber above the second wall height.

19. The liquid management system of claim 1 further comprising a nozzle for spraying liquid, the nozzle being located within the second chamber such that the nozzle is submerged when the liquid level within the second chamber is above the second boundary wall, and the nozzle extends at least partially above the liquid level within the second chamber when the liquid level within the second chamber is at a height that is below the second boundary wall.

20. The liquid management system of claim 1 further comprising a gas supplier wherein the gas supplier is operable to intermittently introduce a gas flow into the liquid contained within the second chamber such that a plurality of gas bubbles are created within the liquid contained in the second chamber.

21. The liquid level management system of claim 1 wherein the liquid level control module is operable to maintain the first level of the liquid in the first chamber at a substantially constant level.

22. The liquid level management system of claim 5 wherein the liquid level control module is operable to control the inflow rate such that the inflow rate substantially equals the overflow rate.

23. The liquid level management system of claim 5 wherein the system controller comprises a processor, a memory in communication with the processor comprising a program operable to configure the processor, and a user input module in communication with the processor that is operable to receive a plurality of input variables and to access and modify the memory and the program, wherein the processor is operable to control the liquid level control module in at least one of the plurality of operating modes based on at least one of the program and the plurality of input variables.

24. The liquid level management system of claim 23 wherein the system controller further comprises a system monitoring module in communication with the processor wherein the system monitoring module is operable to configure the processor to operate the liquid level control module based on a signal received from a transducer, and the transducer is operable to measure at least one of a plurality of variables, the plurality of variables comprising the second level of the liquid in the second chamber, the first level of liquid in the first chamber, the inflow rate, the outflow rate and the overflow rate.

25. The liquid level management system of claim 23 wherein the program further comprises a second level lowering module operable to configure the system controller to lower the second level of the liquid in the second chamber;

a second level maintaining module operable to configure the system controller to maintain the second level of the liquid in the second chamber at a substantially constant level; and a second level raising module operable to configure the system controller to raise the second level of the liquid in the second chamber.

26. The liquid management system as defined in claim 7 wherein the volume controller is further operable to intermittently raise the second level of the liquid in the second chamber above the second wall height.

* * * * *